US006336224B1

(12) United States Patent
Wang

(10) Patent No.: US 6,336,224 B1
(45) Date of Patent: Jan. 8, 2002

(54) CAP STRUCTURE CAPABLE OF ELASTIC ADJUSTING

(75) Inventor: Tai-Kuang Wang, Taipei (TW)

(73) Assignee: Wei Hsu Co., Ltd., Taipei (TW)

( * ) Notice: Subject to any disclaimer, the term of this patent is extended or adjusted under 35 U.S.C. 154(b) by 0 days.

(21) Appl. No.: 09/765,333

(22) Filed: Jan. 22, 2001

(51) Int. Cl.[7] ..... A45B 01/22; A42C 05/02
(52) U.S. Cl. ..... 2/195.3
(58) Field of Search ..... 2/209.3, 209.4, 2/209.13, 175.1, 195.1, 195.2, 195.3, 200.1, 209.12, 183

(56) References Cited

U.S. PATENT DOCUMENTS 1,404,616 A * 1/1922 Kronthal ..... 2/195.2
1,512,316 A * 10/1924 Sherman ..... 2/195.3
1,748,375 A * 2/1930 Wittcoff ..... 2/195.3 X
2,810,913 A * 10/1957 Kennedy ..... 2/195.3
5,715,540 A * 2/1998 Cho ..... 2/183 X
6,049,911 A * 4/2000 Bromberg ..... 2/195.3

* cited by examiner

*Primary Examiner*—Ismael Izaguirre
(74) *Attorney, Agent, or Firm*—Dougherty & Troxell

(57) ABSTRACT

A structure of cap capable of elastic adjusting the cap, being comprised of the elements including a visor, a crown and a tape member, the crown is provided on the inner side of the bottom edge thereof with a tape member which is formed by sewing together two elastic bands and two sweatbands alternately sewn together; the elastic bands are respectively sewn on two elastic middle panels of the crown of the cap to allow adjustment of the size of the crown to suit various head sizes and shapes of different users; thereby an effect of elastically adjusting the crown can be obtained, manufacturing and sampling cost for various types of caps can thus be reduced.

5 Claims, 4 Drawing Sheets

CAP STRUCTURE CAPABLE OF ELASTIC ADJUSTING

BACKGROUND OF THE INVENTION

The present invention is related to a structure of cap capable of elastic ajusting the cap; and especially to such a cap with two elastic bands on the inner sides of the middle panels of the crown in order that the size of the cap can be adjusted to suit different users. The cap thereby can have the feature of unity of size by which manufacturing cost can be reduced.

Since caps of good quality and being convenient to wear were widely used, modes of wearing caps have been being thought highly by users, and caps of various fashions and types have been produced accordingly.

However, most conventional caps are divided into two kinds, i.e., the type of unitary size and the type of variable size. The former type needs making a lot of caps of different sizes for various head sizes, thus the manufacturing cost thereof can be increased. The later type generally is provided on a cap only with an adjustment snap locker or an elastic binding cord to increase the scope of application of a cap; such design can only have an opening at the rear of the cap adjusted, this renders the rear panels of the cap to be subjected to tucking to result an ugly appearance, and it can only be adjusted to suit a specific scope of head size, if the adjustment snap locker is overly or insufficiently adjusted, it can both influence esthetic view of appearance. Thereby, a prior art (as shown in FIGS. 4 and 4-1) has a crown 5 which is sewn with a visor 4, a plurality of elastic members 51 are provided to extend from the central top to the bottom edge of the crown 5. By providing these elastic members 51, the crown 5 can have a plurality of elastically adjustable areas for elastically adjusting the size of the crown 5 to suit various head sizes of users. However, the amount of the elastic members 51 required is quite large, it is expected thereby that manufacturing cost is increased.

SUMMARY OF THE INVENTION

The primary object of the present invention is to provide a structure of cap capable of elastic adjusting the cap, two elastic bands are provided and sewn alternately with two sweatbands to give the function of elastic adjustment, the two elastic bands are respectively sewn on two elastic middle panels of the crown of the cap, so that a larger area which can allow adjustment of the size of the crown can be provided to suit various head sizes and shapes of different users, thereby practicality can be increased.

Another object of the present invention is to provide a structure of cap capable of elastic adjusting the cap, two elastic bands and two sweatbands are provided and are alternately sewn together to give an effect of elastic adjustment of the size of the crown without tucking, thereby manufacturing cost can be reduced.

To get the above stated objects, the present invention is provided on the inner side of the bottom edge of the crown with two elastic bands and two sweatbands alternately sewn together to form a tape; the two elastic bands are respectively sewn on two elastic middle panels of the crown of the cap to allow adjustment of the size of the crown to suit various head sizes and shapes of different users, thereby an effect of elastically adjusting the crown can be obtained, manufacturing cost can be reduced and practicality can be increased.

The present invention will be apparent in its particular structure and characteristics after reading the detailed description of the preferred embodiment thereof in reference to the accompanying drawings.

BRIEF DESCRIPTION OF THE DRAWINGS

FIG. 4-1 is an enlarged sectional view taken from FIG. 4.

DETAILED DESCRIPTION OF THE PREFERRED EMBODIMENT

Figure 1:
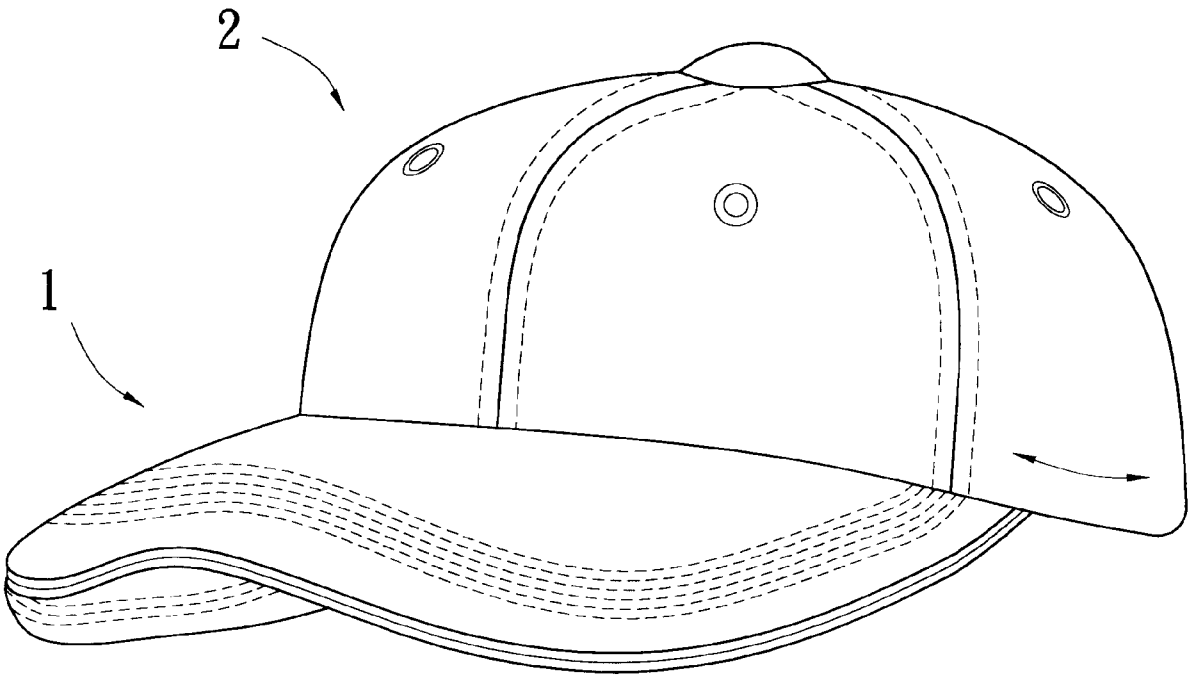
FIG. 1 is a perspective view showing the appearance of an embodiment of the present invention.
Figure 2:
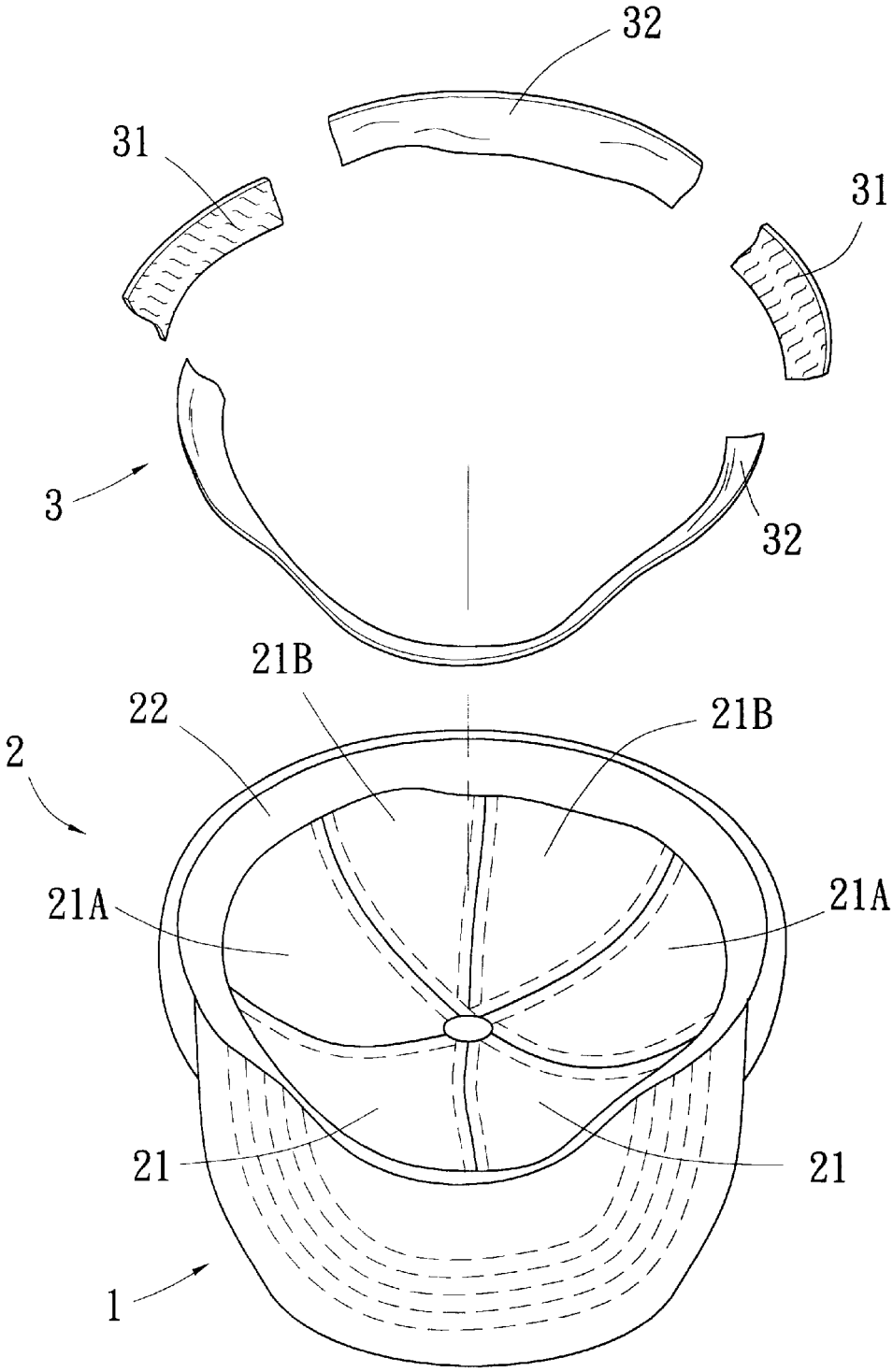
FIG. 2 is an analytic perspective view showing the elements of the embodiment of the present invention.
Figure 3:
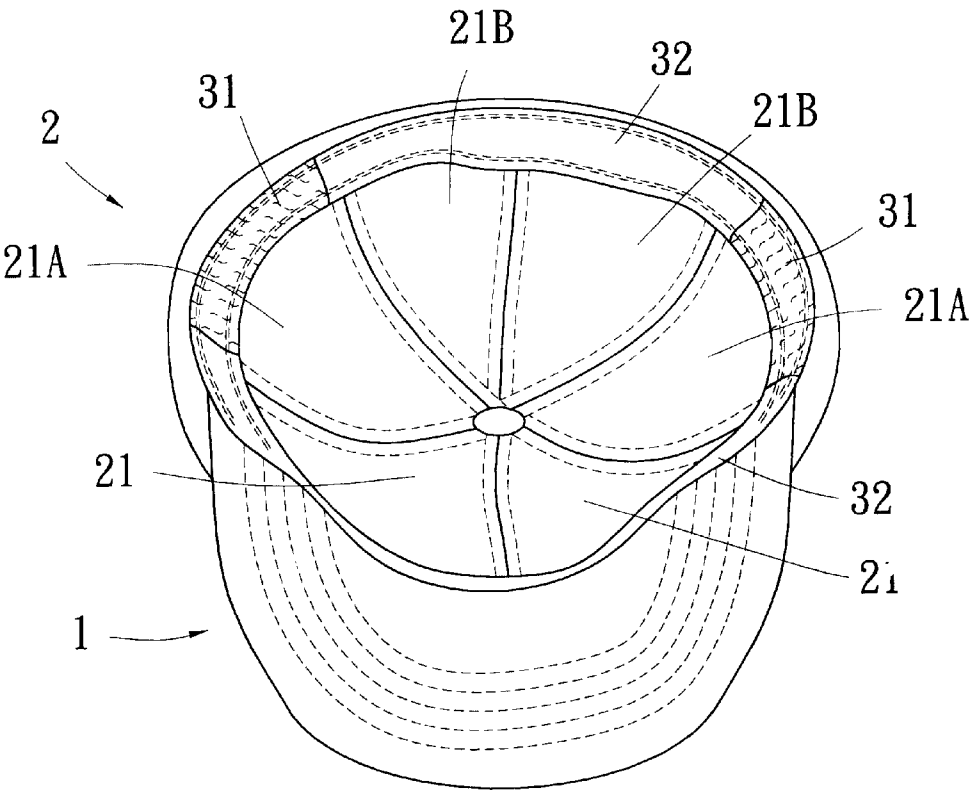
FIG. 3 is a schematic view showing assembling of the embodiment of the present invention.
Figure 4:
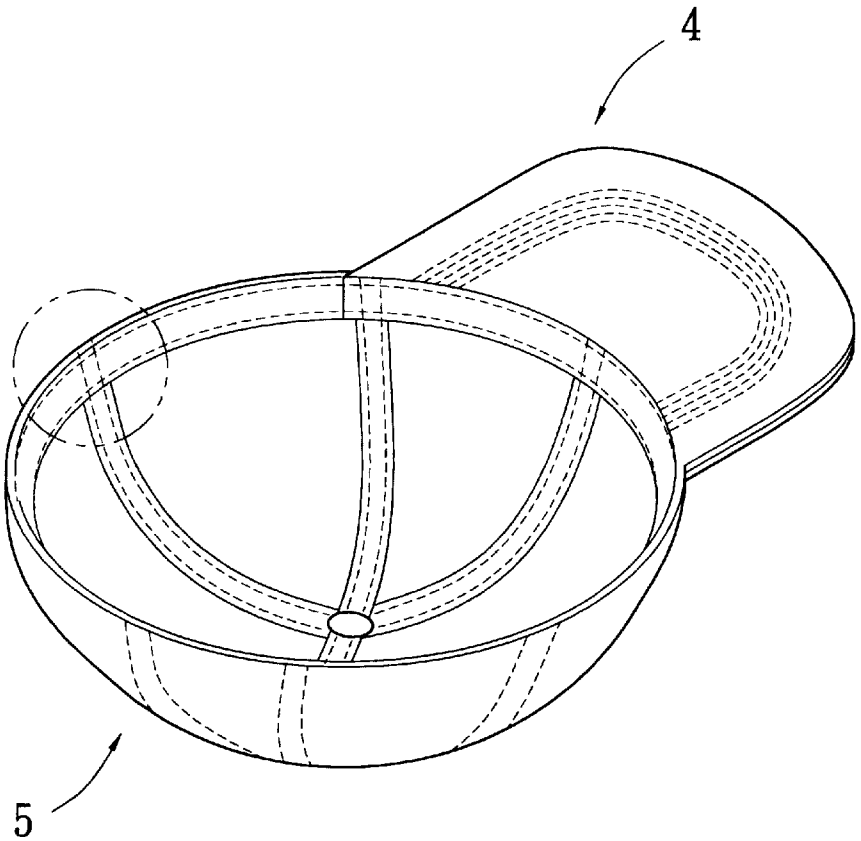
Fig. 4 Prior Art
FIG. 4 is a perspective view showing the appearance of a conventional embodiment.
Figures 1, 4:
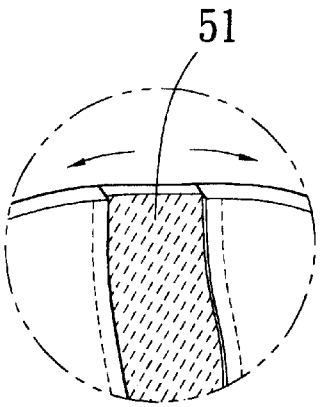
Fig. 4-1 Prior Art

Referring firstly to FIG. 1, 2 and 3, the structure of cap capable of elastic adjusting the cap of the present invention is comprised of the elements including a visor 1, a crown 2 and a tape member 3 etc.

The visor 1 is sewn together with the crown 2 which is formed by sewing together two front panels 21, two elastic middle panels 21A and two rear panels 21B. The inner side 22 of the bottom edge of the crown 2 is provided with the tape member 3 which is formed by sewing together two elastic bands 31 alternately with two sweatbands 32. The two elastic bands 31 are respectively sewn on the two elastic middle panels 21A.

By providing the abovementioned members, the elastic bands 31 and the two sweatbands 32 of the tape member 3 are sewn alternately mutually to form the structure of cap capable of elastic adjusting the cap. Referring to FIG. 2 and 3, the present invention is characterized by that, the tape member 3 is formed by sewing together the two elastic bands 31 alternately with the two sweatbands 32. The two elastic bands 31 are respectively sewn on the two elastic middle panels 21A, by the elasticity of the elastic bands 31 and the two elastic middle panels 21A, the size of the tape member 3 can be adjusted to suit various head sizes and shapes of different users. Thereby an effect of elastically adjusting the crown can be obtained, practicality of the cap can be increased, and the structure of cap capable of elastic adjusting the cap is completed.

Referring again to FIG. 1, 2 and 3, the tape member 3 is formed by sewing together the two elastic bands 31 alternately with the two sweatbands 32 as stated above, then the tape member 3 is sewn onto the inner side 22 of the bottom edge of the crown 2 and the two elastic bands 31 are respectively sewn on the two elastic middle panels 21A, thereby, elastic adjustment function of the tape member 3 renders elastic adjusting of the crown probable. And by the two elastic middle panels 21A, the cap can suit a larger scope of application for various head sizes without tucking, and esthetic view of appearance of the cap can be obtained.

Accordingly, it only needs to sew the visor with the crown of the cap, and to sew a tape member onto the inner side of the bottom edge of the crown (the tape member is formed by sewing together two elastic bands (such as elastic yams, elastic woven bands etc.)) alternately with two sweatbands. The two elastic bands are respectively sewn on the two elastic middle panels of the crown, so that an effect of elastically adjusting the crown can be obtained, and practicality of the cap can be increased.

The present invention has the following advantages:

1. The present invention has a tape member having the function of elastic adjustment to adjust the size of the crown of a cap to suit various head sizes and shapes of different users, thereby, practicality of the cap can be increased.

2. The function of elastic adjustment of the tape member of the present invention is effected with two elastic bands provided and sewn alternately with two sweatbands, thereby amount of the elastic bands can be reduced for obtaining the elastic adjustment effect of adjusting the size of the crown, and thereby cost of manufacturing and production can be lowered.
3. In the present invention, the two elastic bands are respectively sewn on two elastic middle panels of the crown of the cap, the two elastic bands and the two elastic middle panels allow adjustment of the size of the crown without tucking.

In conclusion, the present invention not only can get rid of the defect of conventional caps, but also is provided on the inner side of the bottom edge of the crown with two elastic bands and two sweatbands alternately sewn together to form a tape; the two elastic bands are respectively sewn on two elastic middle panels of the crown of the cap to allow adjustment of the size of the crown to suit various head sizes and shapes of different users; thereby an effect of elastically adjusting the crown can be obtained, manufacturing cost can thus be reduced and practicality can be increased. The present invention can suit various types of caps; it is no doubt in having the value of practicality.

The present invention has been stated as above, what I claim as new and desire to be secured by Letters Patent of the United States are:

1. A structure of cap capable of elastic adjusting the cap, being comprised of the elements including a visor, a crown and a tape member, said visor is sewn together with the crown which is adapted to elastic adjusting, said structure is characterized by that:

said crown is provided on the inner side of the bottom edge thereof with two elastic bands and two sweatbands alternately sewn together to form a tape; said two elastic bands are respectively sewn on two elastic middle panels of said crown of said cap to allow adjustment of the size of said crown.

2. A structure of cap capable of elastic adjusting the cap as in claim 1, wherein, said two elastic bands are made from elastic yarns.

3. A structure of cap capable of elastic adjusting the cap as in claim 1, wherein, said two elastic bands are made from elastic woven bands.

4. A structure of cap capable of elastic adjusting the cap as in claim 1, wherein, said sweatbands are made from non-elastic yarns.

5. A structure of cap capable of elastic adjusting the cap as in claim 1, wherein, said sweatbands are made from non-elastic woven bands.

* * * * *